US006877818B1

(12) United States Patent
Gaertner et al.

(10) Patent No.: US 6,877,818 B1
(45) Date of Patent: Apr. 12, 2005

(54) CONSTRUCTION MACHINE AND MILLING ROLLER

(75) Inventors: Olaf Gaertner, Linz (DE); Guenter Haehn, Koenigswinter (DE); Bernd Holl, Neustadt/Wied (DE)

(73) Assignee: Wirtgen GmbH, Windhagen (DE)

( * ) Notice: Subject to any disclaimer, the term of this patent is extended or adjusted under 35 U.S.C. 154(b) by 2 days.

(21) Appl. No.: 10/030,626

(22) PCT Filed: Jul. 14, 2000

(86) PCT No.: PCT/EP00/06715

§ 371 (c)(1),
(2), (4) Date: Jan. 11, 2002

(87) PCT Pub. No.: WO01/04422

PCT Pub. Date: Jan. 18, 2001

(30) Foreign Application Priority Data

Jul. 14, 1999 (DE) ..... 199 32 396

(51) Int. Cl.[7] ..... E21C 25/10
(52) U.S. Cl. ..... 299/39.8; 404/90; 172/122
(58) Field of Search ..... 404/90; 299/36.1, 299/39.1, 39.4, 39.8; 172/123, 122

(56) References Cited

U.S. PATENT DOCUMENTS 2,874,948 A * 2/1959 Bjorkman et al. ..... 299/37.2
4,704,045 A 11/1987 Taylor et al.
4,720,207 A 1/1988 Salani
5,505,598 A 4/1996 Murray
5,722,789 A * 3/1998 Murray et al. ..... 404/90
5,893,677 A * 4/1999 Haehn et al. ..... 404/90

FOREIGN PATENT DOCUMENTS

DE 3 145 713 A1 5/1983
DE 3911947 A1 * 2/1990 ..... E01C/23/08
DE 4037448 A1 11/1990
JP 04353104 A * 12/1992 ..... E01C/23/12

* cited by examiner

*Primary Examiner*—Davud Bagnell
*Assistant Examiner*—David P Stephenson
(74) *Attorney, Agent, or Firm*—Diller, Ramik & Wight

(57) ABSTRACT

In a construction machine comprising a machine frame (2) having a milling roller (18) arranged for rotation therein, the milling roller (18) comprising a roller base body (19) driven by a milling roller drive device (11 to 15) via a transmission unit (32), and a milling tube (25) to be coaxially mounted on the roller base body (19) and to be attached in a manner allowing exchange thereof, with the milling tube (25) carrying cutting tools on its outer surface (46), it is provided that the milling tube (25) comprises fastening elements (28), radially projecting from the inner surface (44), by which the milling tube (25) can be mounted in a rotationally fixed manner to the roller base body (19) or to a member connected to the roller base body (19).

32 Claims, 8 Drawing Sheets

CONSTRUCTION MACHINE AND MILLING ROLLER

BACKGROUND OF THE INVENTION

Different situations at construction sites and different milling processes make it often necessary to adapt the milling tool to the specific tasks. For instance, when a specific surface roughness is to be obtained, a milling roller with a special line interval of the milling tools or a different tool equipment will be required. In another application, only lanes of specific widths have to be built, thus requiring a milling roller of a specific working width.

Normally, in such situations, a special milling machine has to be used, or the machine must be equipped with a milling roller adapted to the task. Presently, however, the exchange of the rollers is very bothersome and necessitates special auxiliary tools for the mounting and dismounting of the milling roller.

The adapting of milling rollers to different requirements is known in the state of the art.

DE 40 37 448 A describes a road milling machine wherein the roller body is braced between a fixed bearing carrying the drive housing, and a movable bearing arranged opposite to the fixed bearing. The movable bearing is provided with a centering receiving cone, and the support of the movable bearing can be hydraulically displaced. Further, the movable bearing is braced to the fixed bearing via a tie bar.

The approach known from DE 40 37 448 A requires a complex tensioning mechanism with a tie bar and a operating cylinder above the milling roller.

Described in U.S. Pat. No. 4,704,045 is a milling aggregate which is variable in width by use of various roller segments. According to this approach, the roller segments are connected to each other by a plug connection. In a certain manner, this approach can be considered as a milling roller quick-exchange system but suffers from the following disadvantages:

In this approach, it is disadvantageous that the milling rollers are driven hydrostatically by hydraulic motors arranged on both sides of the milling roller. Further, the connection between the segments is a simple plug connection allowing merely for an insufficient centering of the milling motor.

DE 31 45 713 A describes a milling roller for a road milling machine which is supported and driven by a roller bearing and drive device held by a support frame, wherein the milling roller comprises a cylindrical base body. Arranged on one end of the one-sided milling roller are the drive unit of the roller bearing and drive device as well as an annular shoulder supporting the milling tube mounted from the other end. On the side opposite to the drive unit, a holding flange is arranged for fixing the milling tube. According to this concept, the milling roller is provided with a hydrostatic drive which due to its system-inherent disadvantages, e.g. low efficiency, is nowadays hardly used any more in road milling. A further disadvantage of this approach resides in that the milling tubes have to be axially fixed by means of annular shoulders so that the fastening elements are located in the region of the strongest contamination.

U.S. Pat. No. 4,720,207 describes milling tube segments mounted on a roller base body. In this concept, a corner ring segment is first applied on one side. Then the milling tube segments are attached thereon by screw-fitting, with the thread connection arranged within the segments. Disadvantages reside in the considerable expenditure for the screw connections and in that, due to the constant diameter of the base body, the milling depth is restricted when a planetary gear is integrated into the base body.

A different approach wherein particularly the milling depth is not restricted, is described in U.S. Pat. No. 5,505,598. According to this approach, the milling roller tube having the segments with the milling tools mounted thereon, has a stepped shape. The reason therefor is that the transmission required for a mechanical milling roller drive is integrated into the rotor. The planetary gear is arranged on the side opposite the belt drive disk and is driven by a drive shaft guided through the milling shaft.

This transmission arrangement is required to allow for a flush milling. In the region of the roller transmission, the diameter of the milling shaft is adapted corresponding to the constructional volume of the transmission. The rest of the region will then be available for the mounting of segments with the milling tools.

In this approach, it is disadvantageous that different milling processes, such as normal and fine milling, cannot be performed without exchanging the milling rotor.

Present milling rollers and inventions for adapting the milling tools to different applications are focused merely on the adapting of the milling rotor to the respective situation at the construction site.

A problem in the above mentioned state of the art normally resides in that the fastening elements for fixing the milling element to the base body are provided in the surface region of the cylindrical milling tool. Exactly this region, however, is subjected to massive contamination so that the exchange of the milling tube is rendered considerably difficult.

SUMMARY OF THE INVENTION

It is the object of the invention to provide a milling roller and a construction machine which allow for a fast exchange of milling rollers and a simplified handling of the demounted milling rollers and which minimize the time and work required for the exchange of a milling roller.

To achieve this object, a milling roller and a construction machine with the features of claim 1 and 28, respectively, are provided.

In the solution according to the invention, it is advantageously provided that the one-pieced milling tube comprises fastening elements, radially projecting from the inner surface, by which the milling tube can be mounted in a rotationally fixed manner to the roller base body or to a member connected to the roller base body. This solution offers the following advantages:

- For exchange of the milling tool, only the milling tube has to be exchanged.
- The fastening elements are arranged in the region of the least contamination.
- The roller drive with the mechanical milling roller drive elements remains in adjustment relative to the complete power train on the machine.
- Suitability of the device for different milling roller concepts.
- No adjustment of the power train required.
- Centering of the milling tube relative to the milling roller drive elements.
- Easily detachable connection between the milling tube and the milling tube drive element.

Less expenditure for lifting equipment.

Avoidance of imbalances due to axis displacement or angular displacement.

The fastening elements are preferably arranged on at least one end side of the milling tube. In this manner, for instance, the milling tube can be shifted onto the roller base body and be guided and centered by guide elements on the axial end of the roller base body opposite the fastening elements.

Preferably, the milling tube is attached on an end side of the roller base body. In this arrangement, the fastening elements are protected from contamination.

In an advantageous embodiment, the fastening elements comprise flange members projecting radially inward from the milling tube. Fastening screws are guided to extend axially through these flange members and are screwed into the end side of the roller base body.

The milling tube can be arranged at a radial distance from the roller base body. The thus remaining cylindrical hollow space can be used e.g. to fill water thereinto for cooling the milling roller.

Preferably, the milling tube is radially supported at two axially spaced positions on the roller base body. The support can be provided in the form of radial guide elements fastened either radially outside on the roller base body or radially inside on the milling tube. The guide elements comprise support rings or guide elements segmented in the peripheral direction, which guide rings can be arranged e.g. at mutual angular distances of 120°. The guide elements can have a conical (e.g. trapezoidal) shape, a spherical shape or a cylindrical shape when viewed in axial cross section.

Alternately, the support can comprise radial guide elements integrally connected to the at least one fastening element so that the fastening element will simultaneously effect the rotationally fixed axial connection between the milling tube and the roller base body, and the guidance and centering of the milling tube on the roller base body on one axial end.

The radial guide elements can comprise radially acting tensioning elements.

Preferably, the milling tube is of a one-pieced configuration.

Between the milling tube and the roller base body, there can be arranged at least one support ring comprising e.g. at least two radially tensioned segment rings.

This support ring can be arranged for axial displacement relative to the roller base body and the milling tube.

The segment rings of the support ring can be wedge-shaped in cross section.

The at least one support ring can comprise a central ring having a trapezoidal shape in cross section and arranged to be axially tensioned against a radially outer ring and a radially inner ring which have an opposite trapezoidal shape in cross section, and pressing the outer ring against the milling tube and the inner ring against the roller base body.

The at least one support ring can be divided into one or a plurality of parts when viewed in the peripheral direction. This facilitates the mounting of a support ring; for instance, the support ring can comprise two half-rings or segments of 120°.

In one embodiment, it is provided that the transmission unit is arranged at the end of the roller base body facing toward the milling roller drive device. In this arrangement, the transmission unit is preferably integrated into the roller base body.

In another embodiment, it is provided that the transmission unit is arranged at the end of the roller base: body facing away from the milling roller drive device, the transmission unit being connected to the milling roller drive device by a shaft guided through the roller base body. Also on this case, the transmission unit is integrated into the roller base body. Such a construction allows for the use of milling tubes with small milling widths.

The roller base body is supported in two side walls of a roller box, wherein the side wall facing away from the roller drive device can be displaced by a pivoting or axis-parallel movement. In the closed condition, the pivotable or axially displaceable side wall receives the movable bearing of the roller base body.

For this purpose, the movable bearing can comprise a guide member tapering in the outward direction, which is received and centered in a correspondingly tapering recess of the side wall.

Further advantageous embodiments of the invention are mentioned in the further claims.

Exemplary embodiments of the invention will be explained in greater detail hereunder with reference to the drawings.

DESCRIPTION OF THE PREFERRED EMBODIMENT

Figure 1:
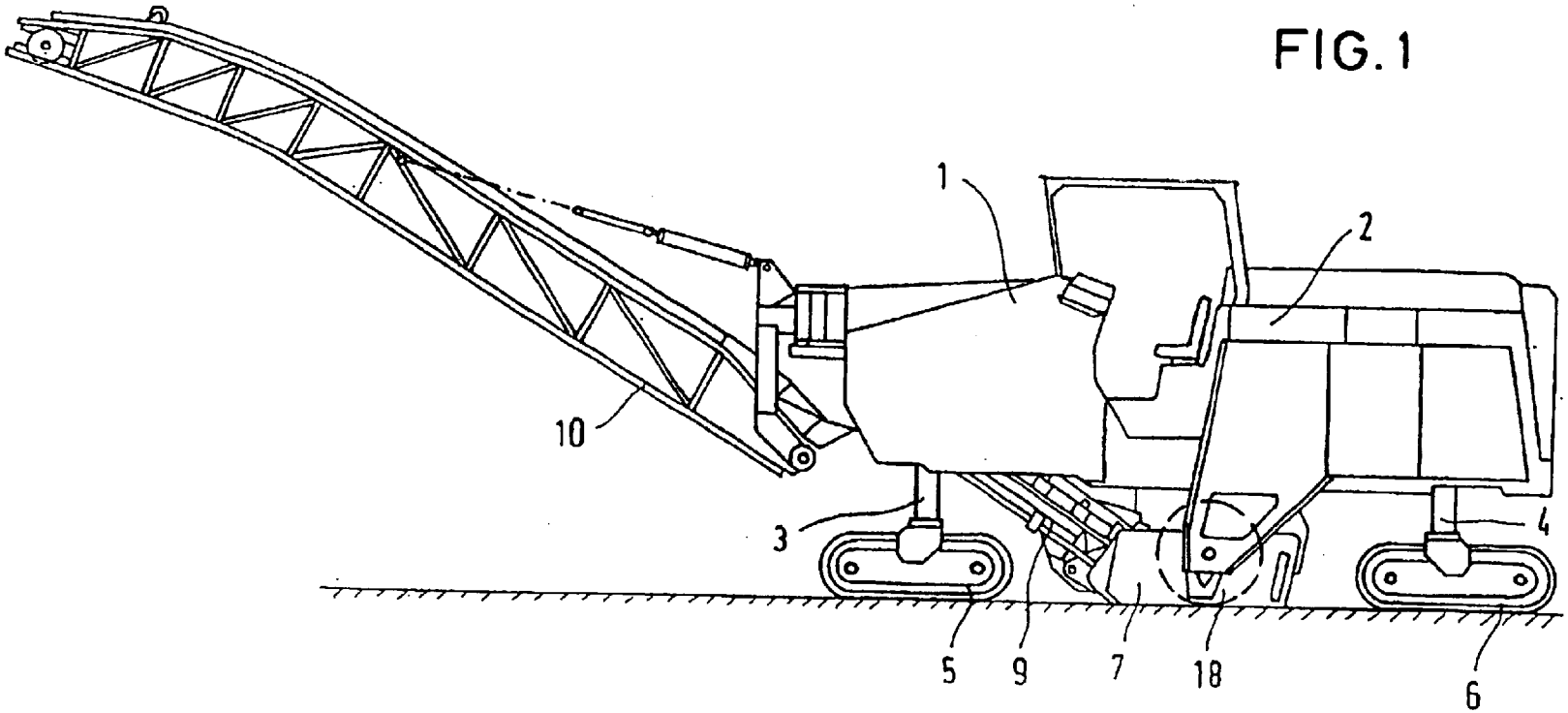
FIG. 1 is a view of a road milling machine.

FIG. 1 illustrates a road milling machine 1 for which the invention described hereunder is primarily used. Road milling machines normally comprise a chassis 2 with an internal combustion engine 11 mounted therein. The chassis of the machine normally comprises lifting columns 3, 4, being adjustable in height and having support wheels or running chains 5,6 mounted thereon.

The milling aggregate 7 with the milling roller 18 is arranged under the chassis 2 and is rigidly connected thereto. The material detached by the milling roller is conveyed onto a first conveyer belt 9 which passes the material on to a second conveyer belt 10 which is adjustable in height and pivotable.

Figure 2:
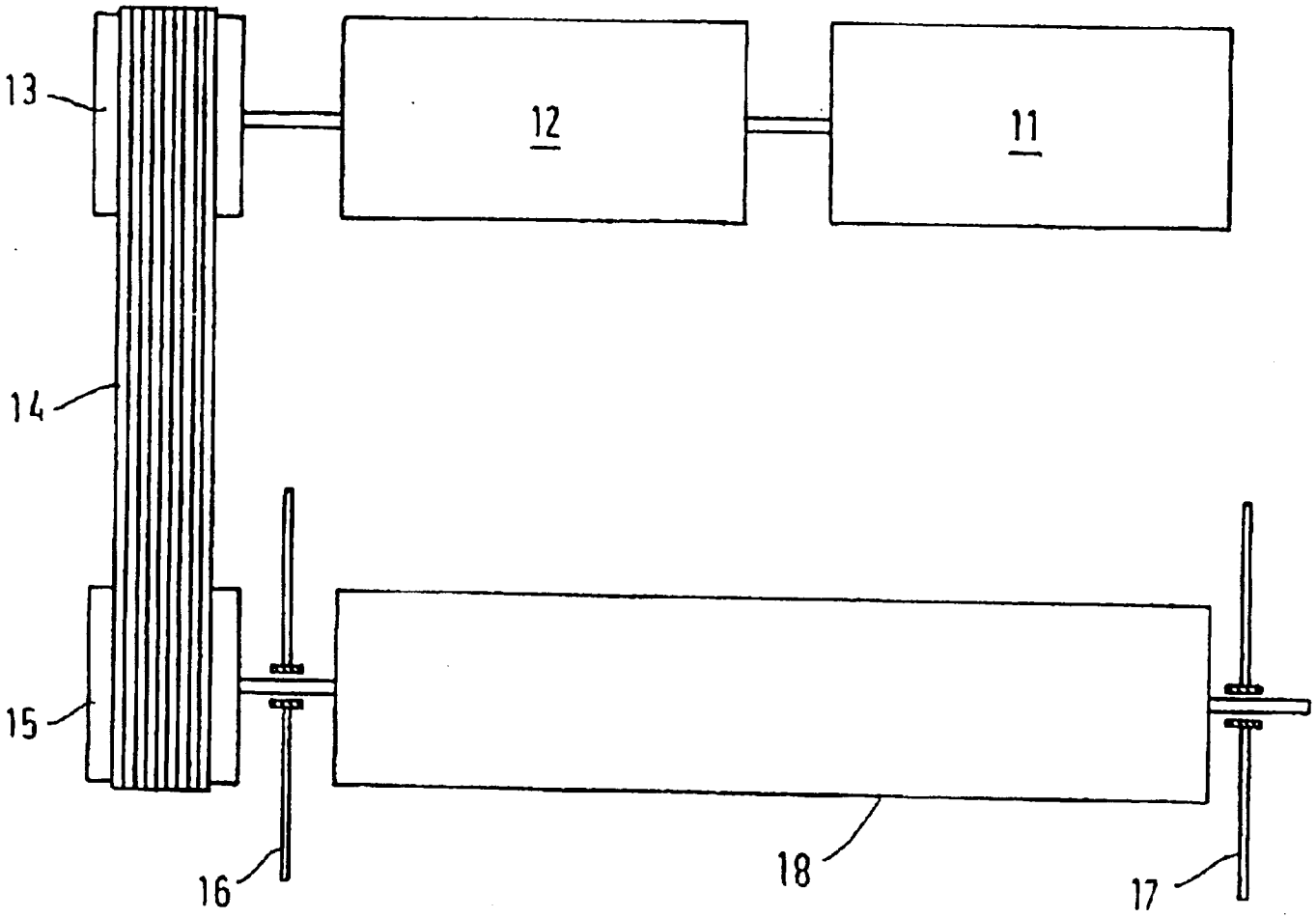
FIG. 2 is a schematic view of the milling roller drive device.

FIG. 2 illustrates the concept of the milling roller drive. An internal combustion engine 11 directly drives a pulley 13. Within this power train, there is normally arranged a pump distributor transmission 12 whereon the hydraulic pumps for the various hydrostatic drives are mounted. The engine power is transmitted via a composite V-belt 14 to a second pulley 15. This pulley is connected to a shaft which transmits the power to a planetary gear arranged within milling roller 18 to reduce the rotational speed of the engine to the required roller speed. The milling roller is supported in the side walls 16 and 17.

Figure 3:
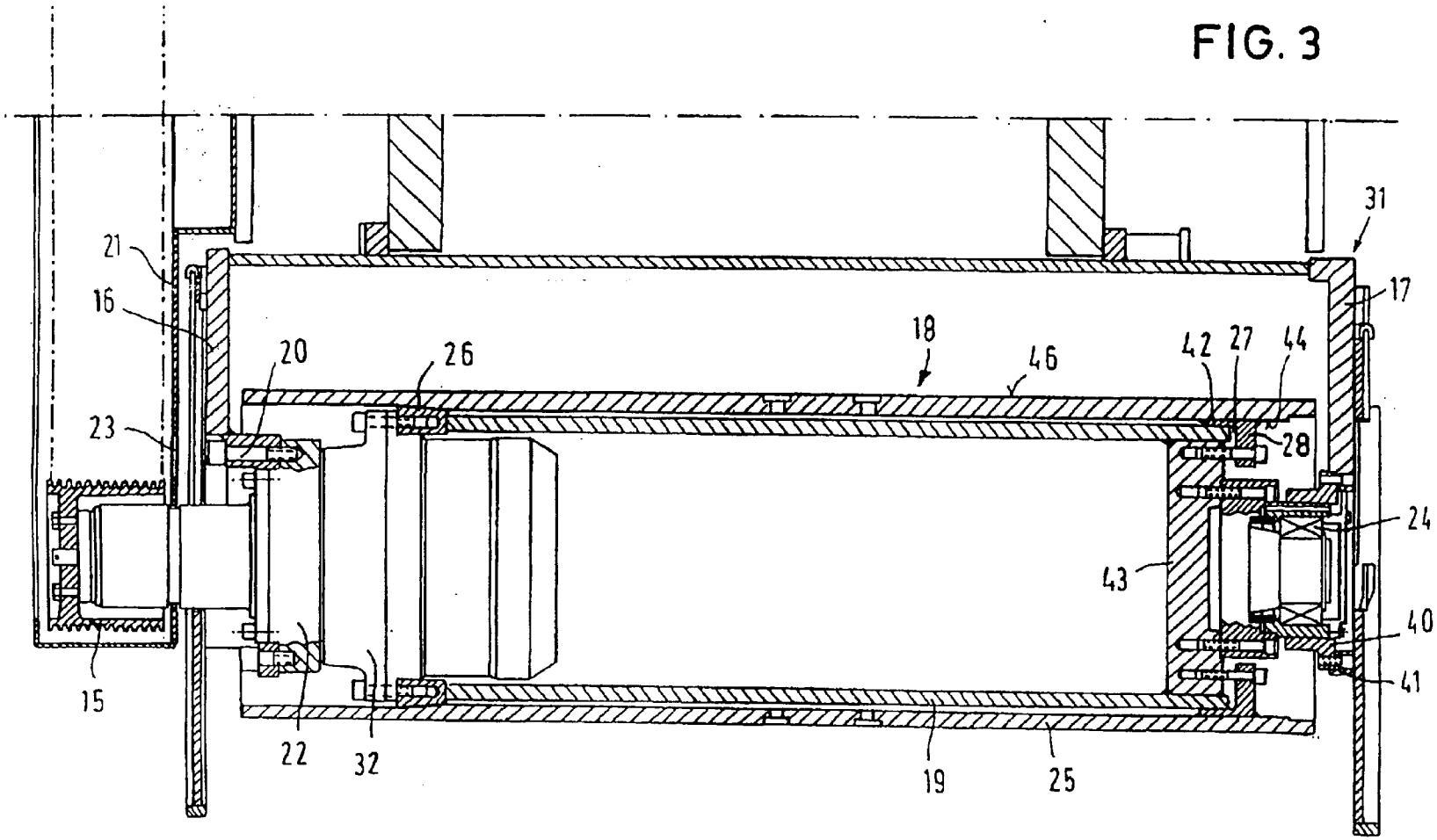
FIG. 3 is a view of a first embodiment of a milling roller supported in a roller box and having an exchangeable milling tube.

FIG. 3 shows a first embodiment of a milling roller 18 supported in a roller box 31. The milling roller 18 comprises a roller base body 19 which by both of its axial ends is supported for rotation in the side walls 16,17 of the roller box 31, and a milling tube 25. For this purpose, the roller base body 19 receives, on an axial end thereof, the transmission unit 32 comprising a planetary gear and is connected therewith in a rotationally fixed manner. The fixed transmission transmission portion 22 of the planetary gear 32 is fastened to side wall 16 by means of a screw connection 20. An outer protective wall 21 can be provided, at the height of the screw connections 20, with openings 23 to allow access to the screw connections 20 from outside. On the axial end of the roller base body 19 opposite to the drive side, a movable bearing 24 is provided which by means of a guide member 40 is centrically supported in a recess 41 of the side wall 17. The guide member 40 and the recess 41 can have conical shapes adapted to each other so that the roller base body 19 with the movable bearing 24 is centrically supported in a simple manner.

For mounting the milling tube 25 on the roller base body 19, the milling tube 25 is shifted onto the roller base body 19. On the drive side of the roller base body 19, a radial guide element 26 is provided which on the one hand is attached to roller base body 19 and on the other hand serves as a screw-connection flange for planetary gear 32. The guide elements 26 can comprise an annular flange or ring segments which fill only a part of the peripheral region. The guide elements 26 are of a slightly conical, spherical or cylindrical cross section and can be welded to the roller base body 19. Generally, the radial support of the milling tube on the roller base body 19 can be provided by positive or frictional engagement. Alternatively, the guide elements 26 can comprise a splined shaft profile.

The guide elements 26 are arranged for centering the exchangeable milling tube 25. Preferred use is made of a conical or spherical cross-sectional shape so as to avoid a canting while mounting the milling tube 25.

Provided on the end of the roller base body 19 facing toward the movable bearing 24 is a radial support of the milling tube 25 by means of a fastening element 28 of milling tube 25. This fastening element 28 comprises e.g. an annular flange projecting radially inward from milling tube 25 and attached to the inner surface 44 of milling tube 25. This annular flange, as shown in FIG. 3, can be L-shaped in cross section, with an axially projecting ring segment or ring 42 radially supporting the milling tube 25 on the roller base body 19 in a fitting manner.

The radially inwardly projecting portion of the fastening element 28 is screwed by means of axial fastening screws to the front end 43 of the roller base body 19 so that the milling tube 25 is connected to roller base body 19 in a rotationally fixed manner. The roller base body 19 can ab ut, by its front side end 43 facing toward the movable bearing 24, on the fastening element 28 comprising the annular flange, without a gap 27 being formed.

On the outer surface 46 of the milling tube 25, milling tools (not shown) are mounted.

To adapt the road construction machine to different requirements at a construction site, only the milling tube 25 has to be exchanged. In this manner, milling tubes 25 of different working widths or with different line intervals of the milling tools for obtaining a different surface roughness of the road paving, can be used and quickly exchanged for other milling tubes 25.

Figure 5:
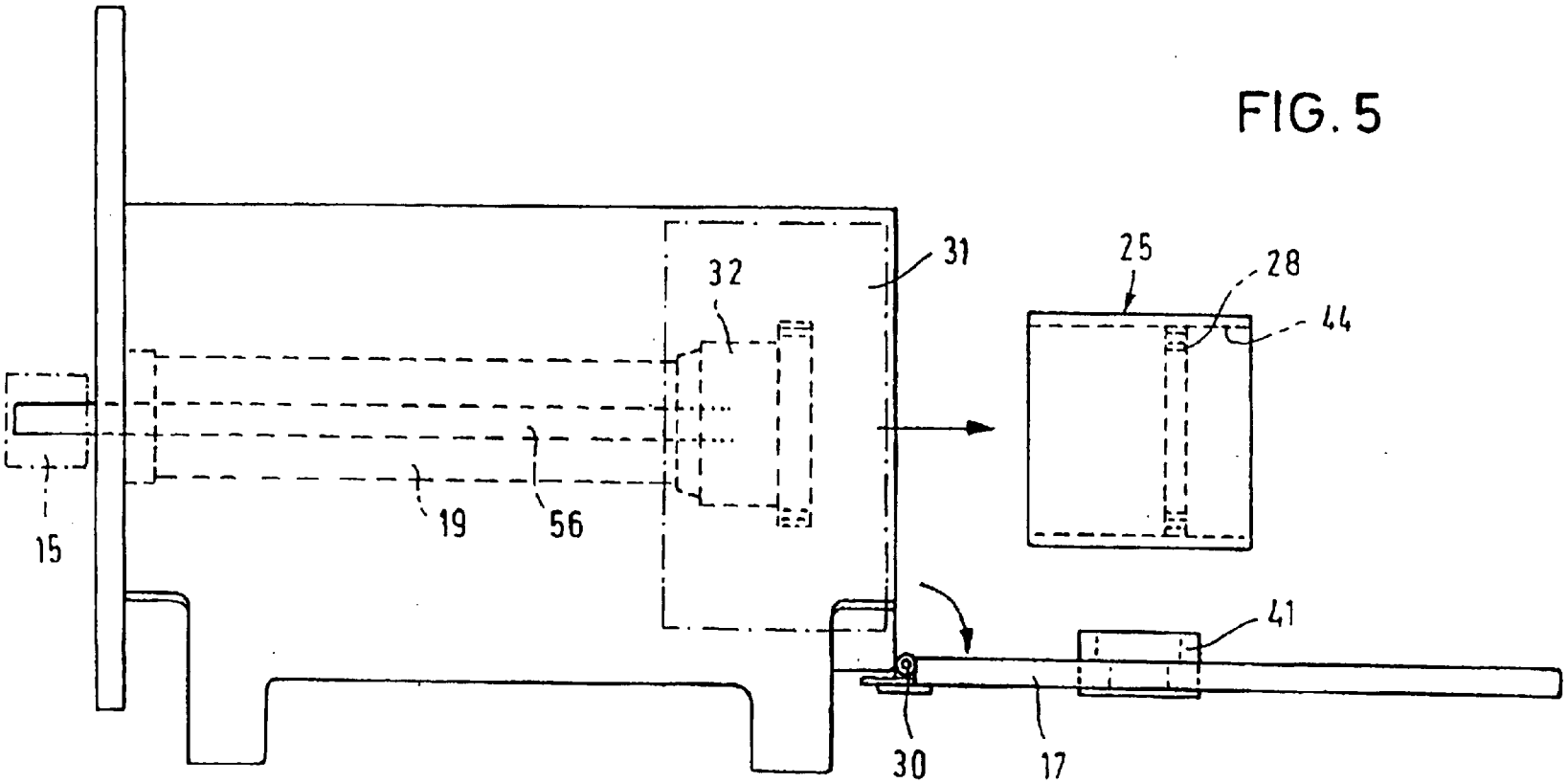
FIG. 5 is a view of a pivotable side wall of the roller box.

For mounting the milling tube 25, the side wall 17 arranged on the movable bearing 24 is demounted or is pivoted through a hinge or a gear 30 as shown in FIG. 5. The hinge 30 or gear is fastened to the roller box 31. After pivoting the side wall 17, the fastening screws of the fastening element 28 can be loosened, and the milling tube 25 can be exchanged by means of simple tools.

Figure 4:
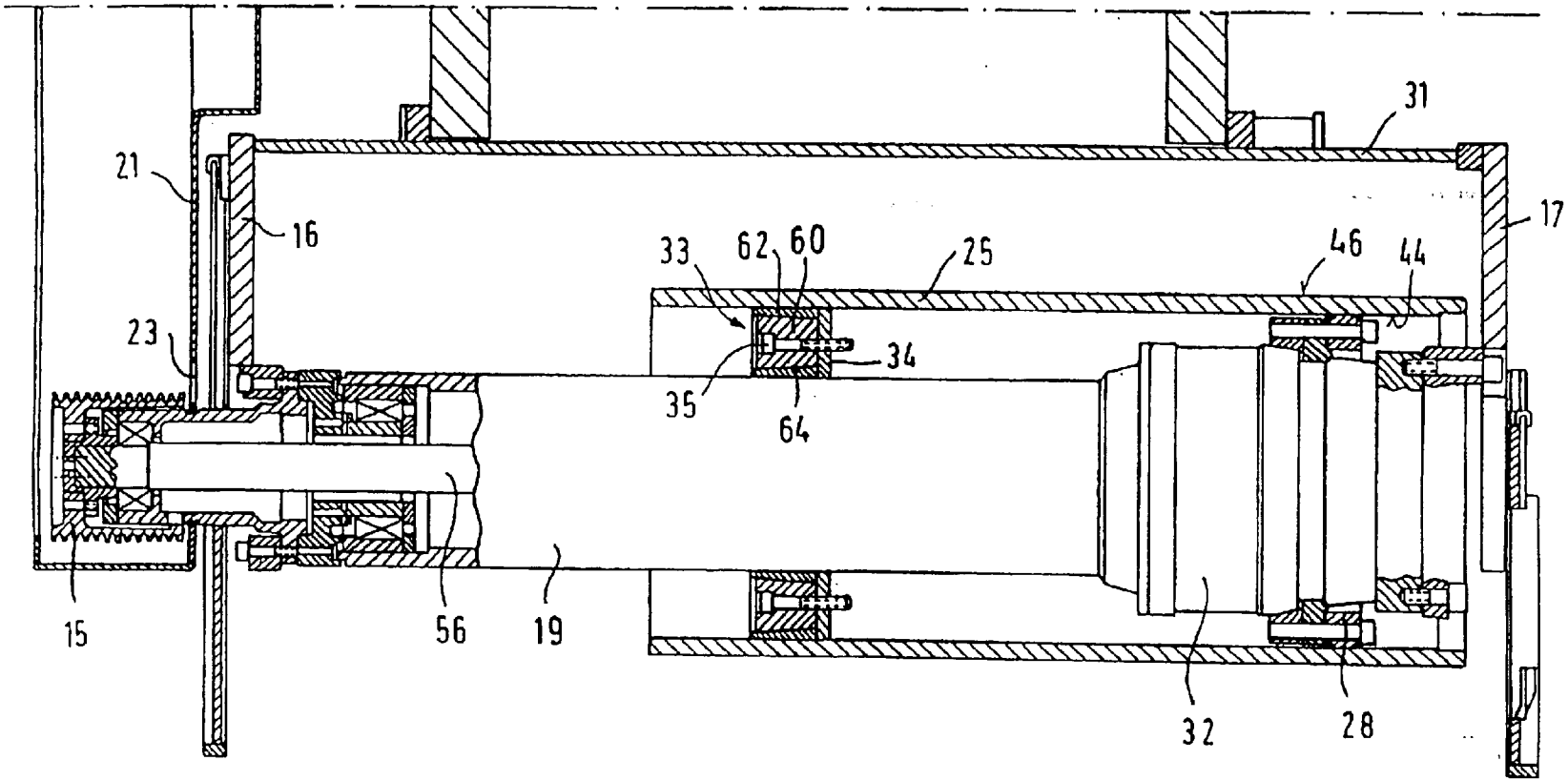
FIG. 4 is a view of a second embodiment of a milling roller supported in a roller box.

FIG. 4 shows a further embodiment for small working widths of the milling tube 25 wherein particularly the planetary gear 32 is arranged on the side of the roller base body 19 facing away from the drive. The planetary gear 32 is connected to the milling roller drive device 11 to 15 via a shaft 56 guided through the roller base body 19. The arrangement of the planetary gear 32 on the side facing away from the drive makes it possible that the milling tube 25 ends nearly flush with the machine outer edge (zero-side). When exchanging the milling tube 25, it is possible, after removal of the side wall 17, the shift the milling tube 25 over the planetary gear 32 until the fastening element 28 abuts the planetary gear 32.

On the end of the milling tube 25 facing away from the planetary gear 32, a radial support is provided for the milling tube in the form of a support ring 33 arranged between the milling tube and the roller base body 19 and consisting of a plurality of segment rings 60, 62, 64. The support ring 33 is axially displaceable both relative to milling tube 25 and relative to roller base body 19. The outer segment rings 62, 64 are conically beveled on the side radially facing toward the central segment ring 60, and the inclination of the conical faces is adapted to the central segment ring 60 having a wedge-shaped cross section. The central segment ring 60 is provided with fastening screws 35 cooperating with an annular or annularly segmented counterpressure plate 34 to thus clap the outer segment rings 62, 64 against the central segment ring 60. By the expansion of the outer segment rings 62, 64, the milling tube 25 is tightly clamped to the roller base body 19 and is at the same time centered.

The interrupted lines indicate the maximum sectional circular diameter and the minimum milling width.

Figure 6:
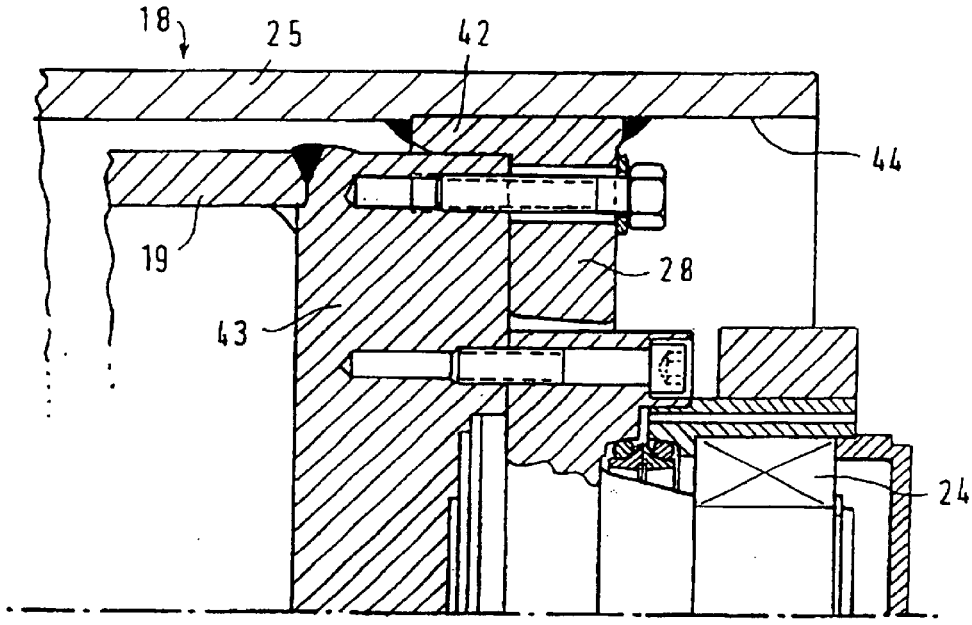
FIGS. 6 and 7 are views of an alternative embodiment of the radial support of the milling tube.
Figure 7:
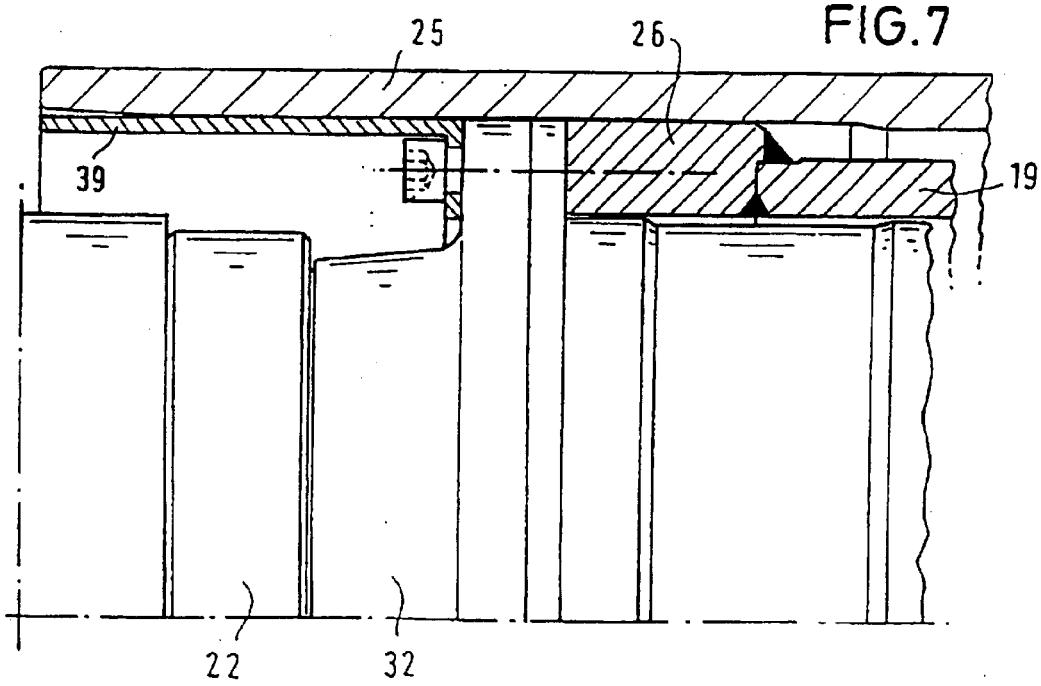

FIGS. 6 and 7 illustrate an alternative radial support of the milling tube 25 on the roller base body 19. In this embodiment, as shown in FIG. 6, the fastening element 28 is in flush axial abutment on the end side 43 of roller base body 19 without a gap.

The free end of the roller base body 19 has a cylindrical guidance element 26 welded thereto, abutting in a closely fitting manner on the inner surface 44 of milling tube 25. Further, the inner surface 44 of milling tube 25 is on the free end of the tube protected by a protective sleeve 39 so that the material detached by the milling roller 25 cannot damage the inner surface 44 of milling tube 25. Preferably, the protective sleeve 39 is fastened to the planetary gear 32 by a flange.

Figure 8:
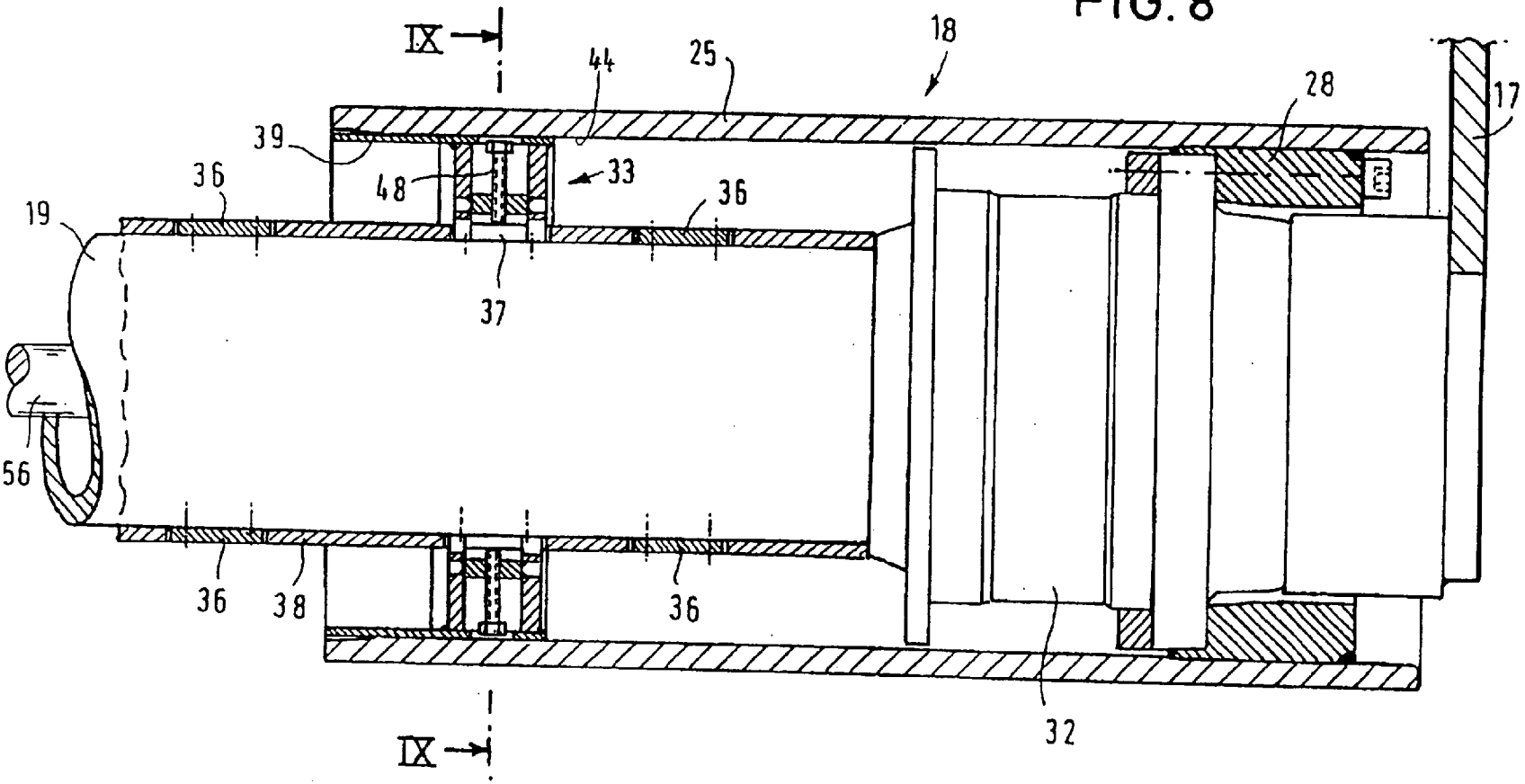
FIG. 8 is a view of a third embodiment of a milling tube.

FIG. 8 shows an alternative embodiment of the arrangement according to FIG. 4 wherein the fastening element 28 rests on a flange portion of the planetary gear 32 with close fit. A support ring 33 is screwed to the roller base body 19, and the roller base body 19 can be mounted on different axial positions depending on the length of the milling tube 25. For this purpose, the roller base body 19 comprises a protective tube 38 exchangeably mounted on the roller base body 19 in a rotationally fixed manner. The protective tube 38 serves for protecting the roller base body 19 from damage from the milled material. In the protective tune 38, recesses 37 are arranged in a uniform distribution at predetermined axial distances on the circumference, in which recesses the support ring 33 can be mounted to the roller base body 19. The axial distances of the recesses 37 are adapted to the lengths of different milling tubes 25. If no support ring 33 has been mounted, the recesses 37 are closed by a lid 36 so that also in the region of the recesses 37 no damage can be caused to the roller base body 19. Preferably, it is provided that the support ring 33 is combined with a protective sleeve 39 arranged to protect the inner surface 44 on the free end of milling tube 25.

Figure 9:
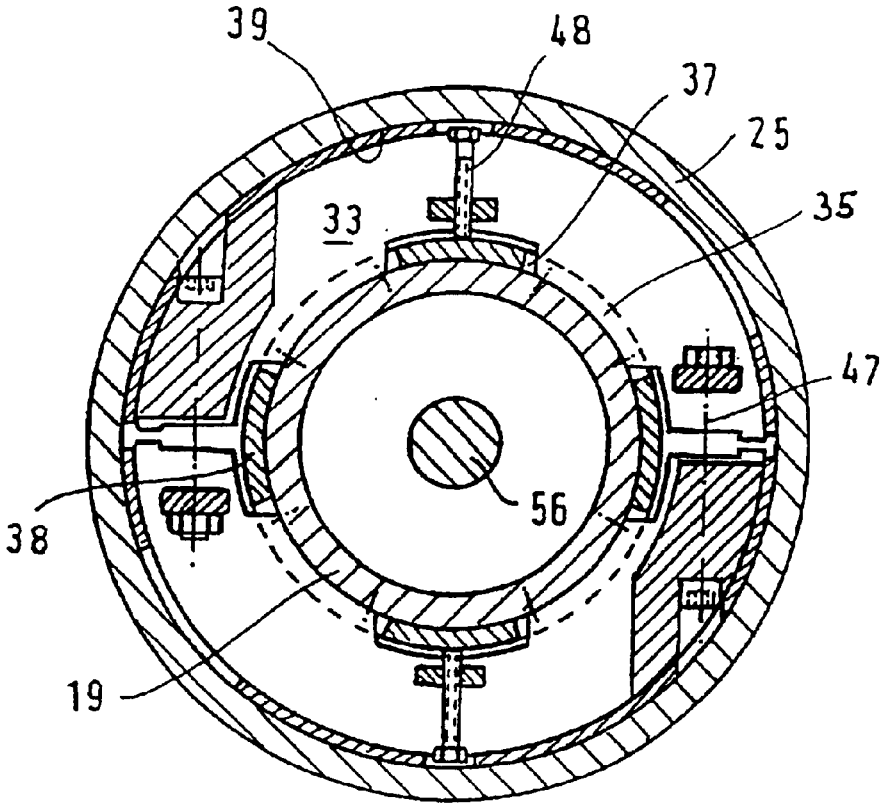
FIG. 9 is a sectional view taken along the line IX—IX In FIG. 8.

FIG. 9 is a sectional view taken along the line IX—IX in FIG. 8. The support ring 33 consists of two halves which can be screwed tight relative to each other on the roller base body 19 by means of screws. In this arrangement, projections 35 of support ring 33 engage the recesses 37 of the protective tube 38. The support ring halves can be screwed to the roller base body 19 on the projections 35. For axial displacement of the support ring 33, the screws 47 are detached after removal of milling tube 25 so that the two halves of the support ring 33 can be pulled apart at least so far that the support ring 33 can be shifted over the protective tube 38. For spreading the two halves of the support ring 33 apart, use is made of pressing screws 48 so that the support ring 33 can be mounted without large force and time requirement on a different axial position on the roller base body 19 without detaching the screws 47 completely. The recesses 37 are axially arranged in the protective tube 38 in such a manner that the protective shell 39, coupled to support ring 33, for the inner surface 44 of the milling tube ends flush with the free end of the respective inserted milling tube 25.

Although a preferred embodiment of the invention has been specifically illustrated and described herein, it is to be understood that minor variations may be made in the apparatus without departing from the spirit and scope of the invention, as defined the appended claims.

What is claimed is:

1. A milling roller comprising a roller base body (19) driven by a milling roller drive device (11 to 15) via a transmission unit (32), a one-piece tubular milling tube (25) coaxially slidably mounted from one side on the roller base body (19) in a manner allowing exchange thereof, the milling tube (25) carrying cutting tools on an outer surface (46), the milling tube (25) includes fastening elements (28) radially projecting from an inner surface (44) of the milling tube (25) by which the milling tube (25) can be secured in a rotationally fixed manner to at least one of the roller base body (19) and a member connected to the roller base body (19), means for securing said fastening elements (28) to at least one of the roller base body (19) and a member connected to the roller base body (19), a side wall (17) at said roller base body one side, side wall (17) at said roller base body one side, said milling roller drive device (11 to 15) being located at a side of said roller base body opposite said one side, and said securing means being accessible at said roller base body one side via said side wall (17).

2. The milling roller according to claim 1 wherein the fastening elements (28) are arranged on said roller base body one side.

3. The milling roller according to claim 1 wherein the milling tube (25) is fastened to an axial end of the roller base body (19) at said roller base body one side and is radially supported on another axial end of said roller base body opposite side.

4. The milling roller according to claim 1 wherein the inwardly projection fastening elements (28) are flange members projecting radially inwardly from the milling tube (25).

5. The milling roller according to claim 1 wherein me milling tube (25) is arranged at a radial distance from the roller base body.

6. The milling roller according to claim 1 wherein the milling tube (25) projects axially relative to the roller base body (19).

7. The milling roller according to claim 1 wherein the member connected to the roller base body (19) includes the transmission unit (32) integrated into the roller base body (19).

8. The milling roller according to claim 1 including means (26; 33; 42) for radially supporting the milling tube (25) at two axially spaced positions on the roller base body (19).

9. The milling roller according to claim 8 wherein the radially supporting means includes radial guide elements (26; 33; 42) fastened at least one of (a) radially outside on the roller base body (19), (b) radially inside on the milling tube (25), and (c) between the roller base body (19) and the milling tube (25).

10. The milling roller according to claim 9, wherein the radially supporting means includes radial guide elements (26), and the guide elements (26) are arranged on said opposite side of the roller base body (19).

11. The milling roller according to claim 10 wherein the radial guide elements include radially acting tensioning elements (60, 62, 64).

12. The milling roller according to claim 9 wherein the radial guide elements include radially acting tensioning elements (60, 62, 64).

13. The milling roller according to claim 8 wherein the radially supporting means includes radial guide elements (42), and the guide elements (42) are integrally connected to the fastening elements (28).

14. The milling roller according to claim 1 wherein at least one support ring (33) is arranged as a radial guiding element between the milling tube (25) and the roller base body (19).

15. The milling roller according to claim 14 wherein the at least one support ring (33) is arranged for axial displacement relative to the roller base body (19) and the milling tube (25).

16. The milling roller according to claim 15 wherein the at least one support ring (33) includes at least two radially tensioned segment rings (60, 62, 64).

17. The milling roller according to claim 16 wherein the segment rings (62, 62, 64) are wedge-shaped in cross section.

18. The milling roller according to claim 16 wherein the at least one support ring (33) is arranged for axial displacement relative to the roller base body (19) and the milling tube (25).

19. The milling roller according to claim 15 wherein the segment rings (62, 62, 64) are wedge-shaped in cross section.

20. The milling roller according to claim 14 wherein the at least one support ring (33) includes a central ring (60) having a trapezoidal shape in cross section arranged to be axially tensioned against a radially outer ring (62) and a radially inner ring (64) which has an opposite trapezoidal shape in cross-section, and the outer ring (62) presses against the milling tube (25) and the inner ring (64) presses against the roller bass body (19).

21. The milling roller claim 14 wherein the at least one support ring (33) is divided into at least two parts in the circumferential direction.

22. The milling roller according to claim 14 wherein a protective sleeve (39) projects from the support ring (33).

23. The milling roller according to claim 14 wherein the protective tube (38) includes recesses (37) arranged in a uniform distribution at predetermined axial distances on the circumference for receiving the support ring (33).

24. The milling roller according to claim 1 wherein the transmission unit (32) is arranged at the roller base body opposite side adjacent the milling roller drive device (11 to 15).

25. The milling roller according to claim 1 wherein the transmission unit (32) is arranged at the roller base body one side remote from the milling roller drive device (11 to 15), and the transmission unit (32) is connected to the milling roller drive device (11 to 15) by a shaft (56) guided through the roller base body (19).

26. The milling roller according to claim 1 wherein the roller base body (19) is supported in said first-mentioned side wall (17) and another side wall (16) of a roller box (31), said first-mentioned side wall (17) being displaced by one of a pivoting and axis-parallel movement, and the first-mentioned side wall (17) in the closed condition receives a movable bearing (24) of the roller base body (19).

27. The milling roller according to claim 26 wherein the movable bearing (24) includes an outwardly tapering guide member (40) and said first-mentioned side wall (17) includes a correspondingly tapering recess (41) receiving a guide member (40).

28. The milling roller according to claim 1 wherein the roller base body (19) is supported in said first-mentioned side wall (17) and another side wall (16) of a roller box (31), and a machine cover (21) arranged on the milling roller drive device (11 to 15) is provided with openings (23) allowing access to fastening elements (20) between the side wall (16) facing toward the milling roller drive device (11 to 15) and the transmission unit (32) without demounting of machine parts.

29. The milling roller according to claim 1 wherein a free end of the milling tube (25) is provided with a protective sleeve (39) for the inner surface (44).

30. The milling roller according to claim 29 wherein the protective sleeve (39) projects from the supporting ring (33).

31. The milling roller according to claim 1 wherein the roller base body (19) is surrounded by a protective tube (38).

32. The milling roller according to claim 31 wherein the protective tube (38) includes recesses (37) arranged in a uniform distribution at predetermined axial distances on the circumference for receiving the support ring (33).

* * * * *